US005144784A

United States Patent [19]

Marti

[11] Patent Number: 5,144,784

[45] Date of Patent: Sep. 8, 1992

[54] WALL WITH ELONGATE MEMBERS

[76] Inventor: Werner Marti, Wolfensbergerstrasse 19, CH-9424 Rheineck, Switzerland

[21] Appl. No.: 455,378

[22] PCT Filed: Mar. 16, 1989

[86] PCT No.: PCT/CH89/00052

§ 371 Date: Nov. 17, 1989

§ 102(e) Date: Jan. 17, 1990

[87] PCT Pub. No.: WO89/08759

PCT Pub. Date: Sep. 21, 1989

[30] Foreign Application Priority Data

Mar. 18, 1988 [CH] Switzerland ..... 1041/88

[51] Int. Cl.[5] ..... E04H 12/18

[52] U.S. Cl. ..... 52/646; 403/245; 403/240; 403/171

[58] Field of Search ..... 52/645, 646, 109, 63, 52/285; 40/610; 403/245, 246, 407.1, 231, 171, 176

[56] References Cited

U.S. PATENT DOCUMENTS

| | | | |
|---|---|---|---|
| 3,975,872 | 8/1976 | Pinero | 52/645 X |
| 4,131,376 | 12/1978 | Busse | 52/285 X |
| 4,473,986 | 10/1984 | Zeigler | 52/645 |
| 4,512,097 | 4/1985 | Zeigler | 52/109 X |
| 4,637,180 | 1/1987 | Zeigler | 52/109 |
| 4,658,560 | 4/1987 | Beaulieu . | |
| 4,679,961 | 7/1987 | Stewart | 52/646 X |
| 4,809,471 | 3/1989 | Wichman et al. | 52/109 |
| 4,838,003 | 6/1989 | Zeigler | 52/646 |
| 4,846,204 | 7/1989 | Kyu | 52/109 X |

FOREIGN PATENT DOCUMENTS 1082711 6/1960 Fed. Rep. of Germany .

*Primary Examiner*—David A. Scherbel
*Assistant Examiner*—Creighton Smith
*Attorney, Agent, or Firm*—Wenger, Cantor, Mueller & Player

[57] ABSTRACT

The wall contains elongate members (1) which are connected to one another by means of junction pieces (2). Each member (1) has a tubular portion (7) and at least one endpiece (10). That part (12) of the endpiece (10) located outside the portion (7) is equipped with a gripping wheel (30) for making and breaking the connection between the elongate member (1) and the junction piece (2). The junction piece (2) contains a baseplate (40) with receiving parts (41) for the endpiece (10) of the member (1) and a device (65) which makes it possible to fasten further wall components (3,9,71) to the junction pieces (2). The receiving part (41) comprises cheeks (42,43), between which extends an axle (45). A slot in the gripping wheel (30) surrounds this axle (45) when the endpiece (10) is located in the receiving part (41). The baseplate (40) is equipped with orifices (83) which allow the connection of wall plates (3,4) and hinges (90).

9 Claims, 6 Drawing Sheets

WALL WITH ELONGATE MEMBERS

The present invention relates to a wall with elongate members which are connected to one another by means of junction pieces, each elongate member having a tubular portion and at least one endpiece, and part of the endpiece being located in the tubular portion.

A wall of this type is already known. The junction piece of this wall has a virtually square contour in a plan view. On the circumferential region of this basic body, two axle portions are formed on each side, a bar-shaped element being fastened in each of these axle portions. The endpiece of each elongate member of this known wall has two halves, the longitudinal axis of this member lying in the parting plane of the endpiece halves. The endpiece connection part located in the tubular portion is equipped with a hinge, by means of which the two endpiece halves are connected to one another. In this endpiece portion there is, between the said halves, a spring which presses the endpiece halves apart from one another and which also carries a projection. This projection passes through one of the endpiece halves and, in the non-actuated state, also through an orifice in the tubular portion of the elongate member. The ends of the endpiece halves which are located outside the tubular portion are each equipped with a half-shell. One of the bar-shaped elements of the junction piece can be clamped between these half-shells.

In the assembled state, the connection part of the endpiece is located in the tube and this tube presses the endpiece halves together. Consequently, the bar-shaped element of the junction piece located between the two half-shells is clamped between the half-shells. When the connection between the junction piece and the elongate member is to be broken, the projection is pressed down until it comes out of the orifice in the tubular portion. The endpiece can then be drawn out of the tubular piece. The spring mentioned causes the half-shells to move away from one another and the bar-shaped element of the junction piece thereby comes free A disadvantage of this known wall is, for example, that the endpiece has to be pulled out of the tube so that the connection between the junction piece and the respective elongate member can be broken. On the other hand, to make such a connection, the endpiece has to be inserted into the tube, and for this the projection has to be pressed down with a finger. This can sometimes cause injury to the hand of the person building the wall. Furthermore, signs of wear in the endpiece made of plastic can occur if this has to be inserted several times into the tubular portions made of metal. Where a large wall and therefore a large number of connection points are concerned, the assembly and dismantling of this wall can be complicated, etc.

The object of the present invention is to eliminate this and other disadvantages of the known wall.

In the wall of the generic type mentioned in the introduction, this object is achieved by means of a measure which is defined in the characterizing clause of claim 1.

Exemplary embodiments of the present invention are explained in detail below by reference to the accompanying drawings. In these:

Figure 1:
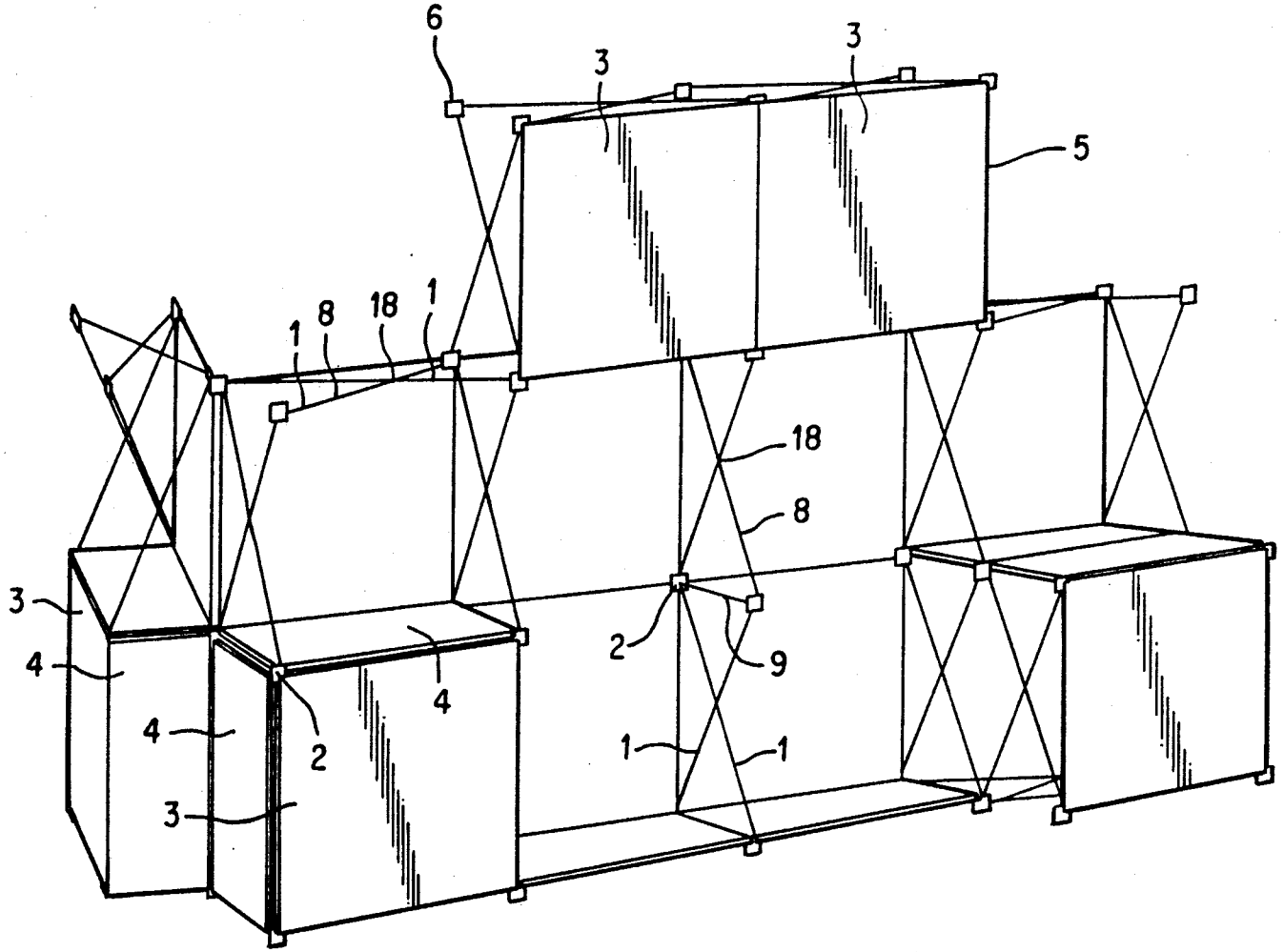
FIG. 1 shows the present wall in perspective.
Figure 3:
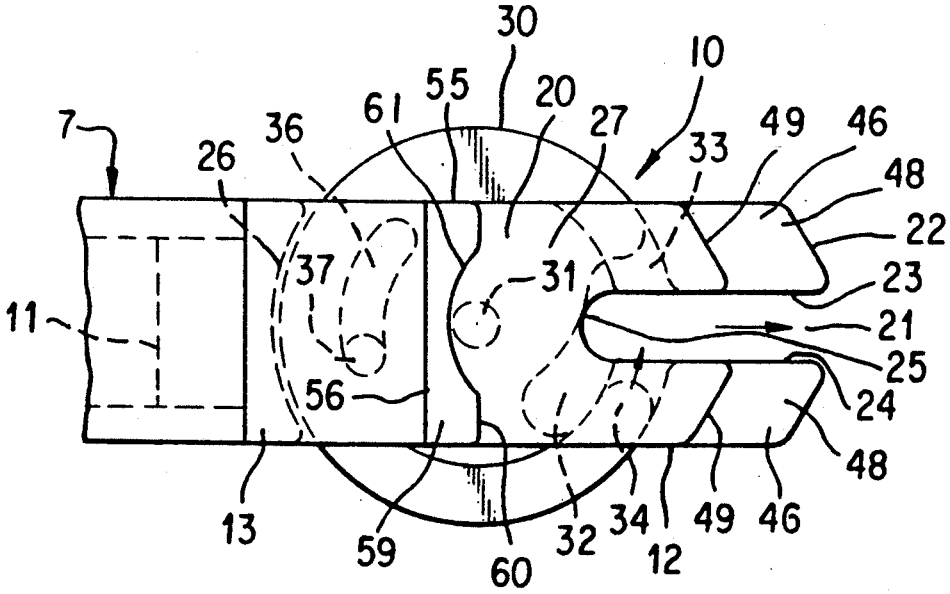
Figure 4:
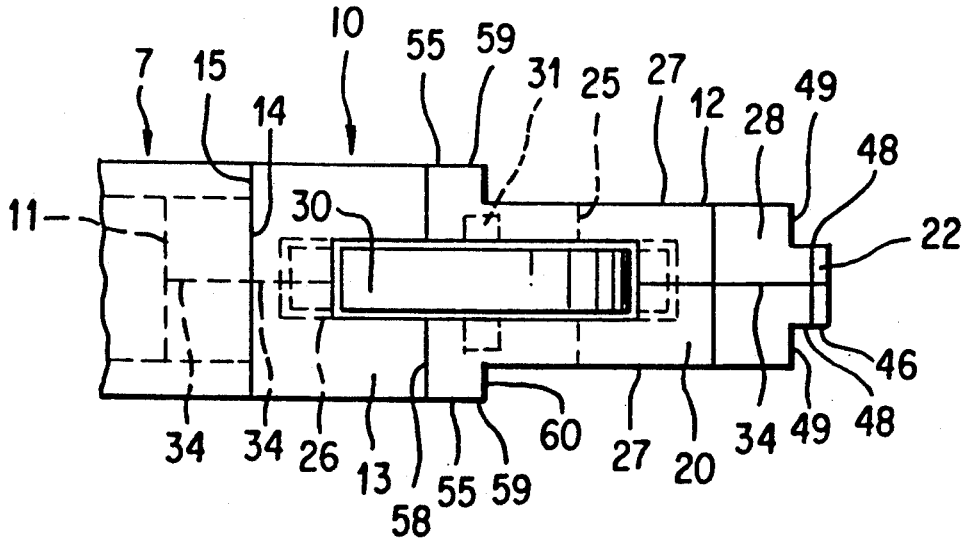
Figure 5:
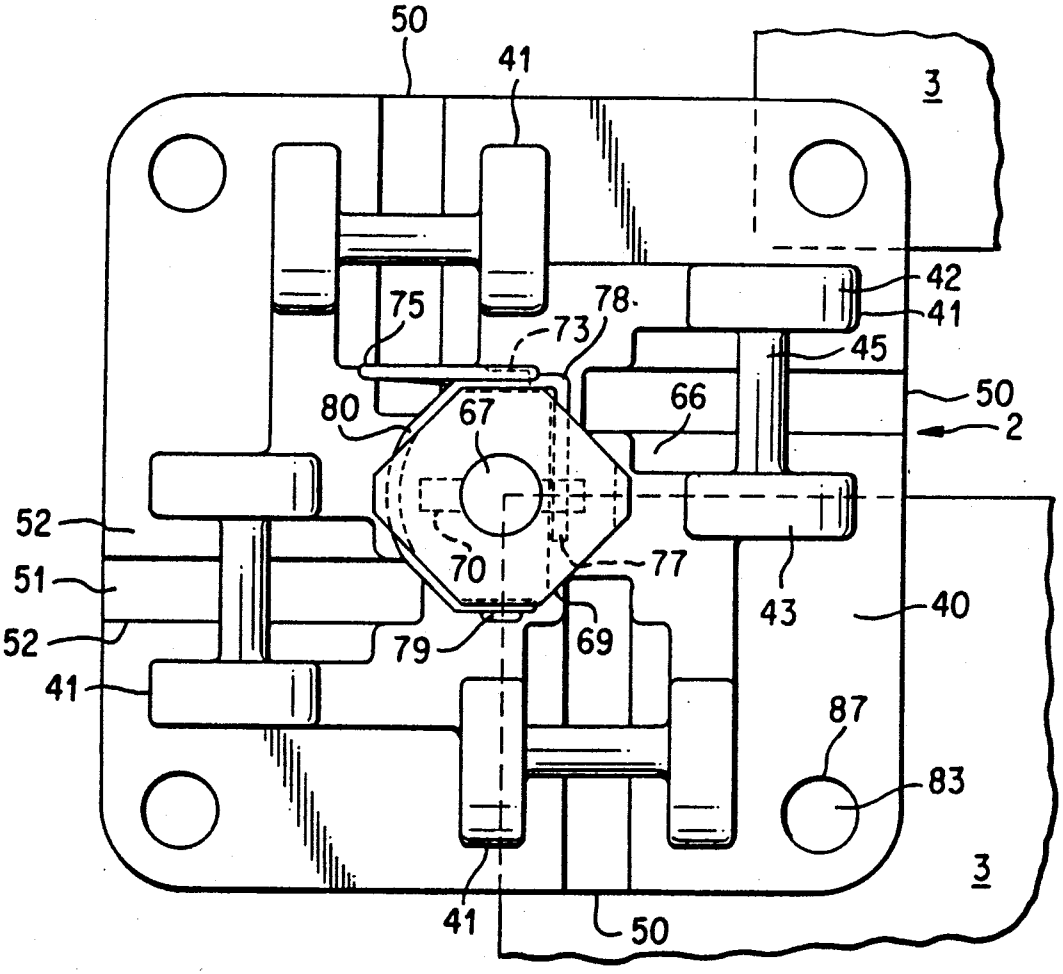
Figure 6:
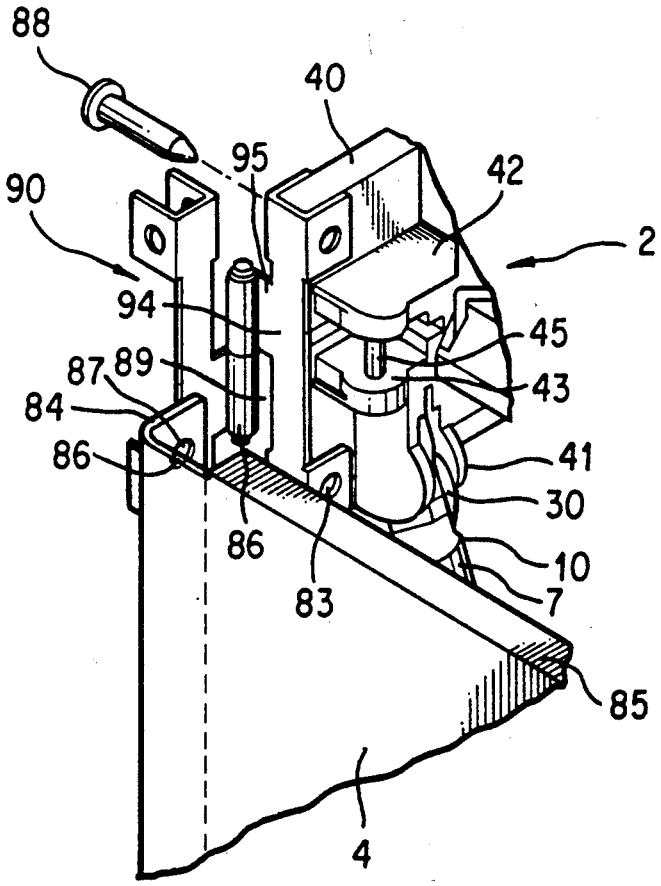
Figure 7:
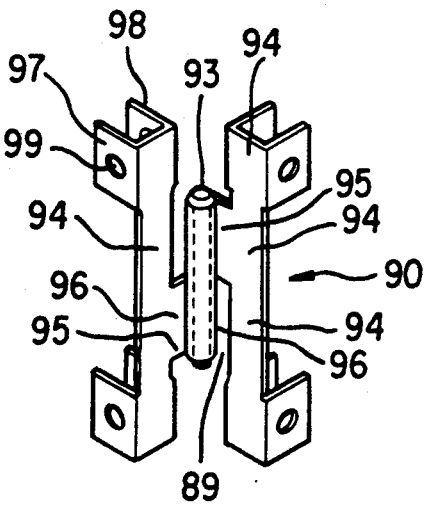
Figure 8:
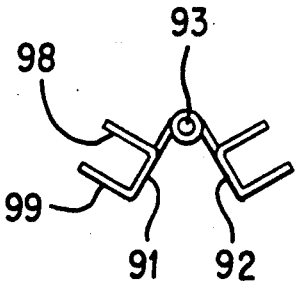
Figure 9:
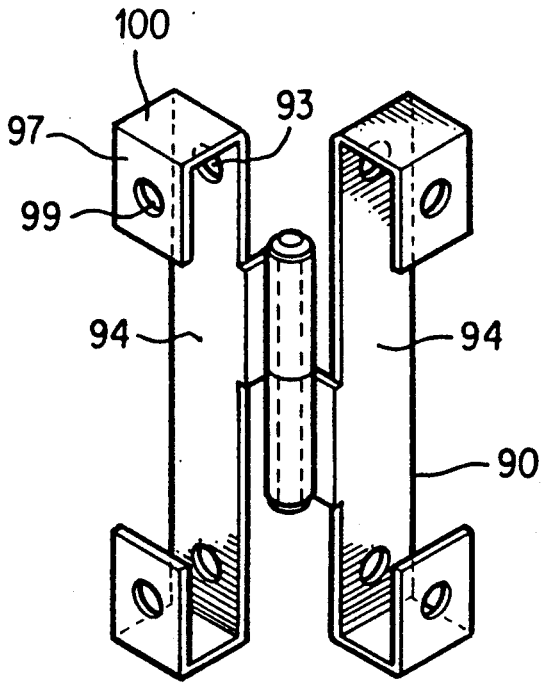
Figure 10:
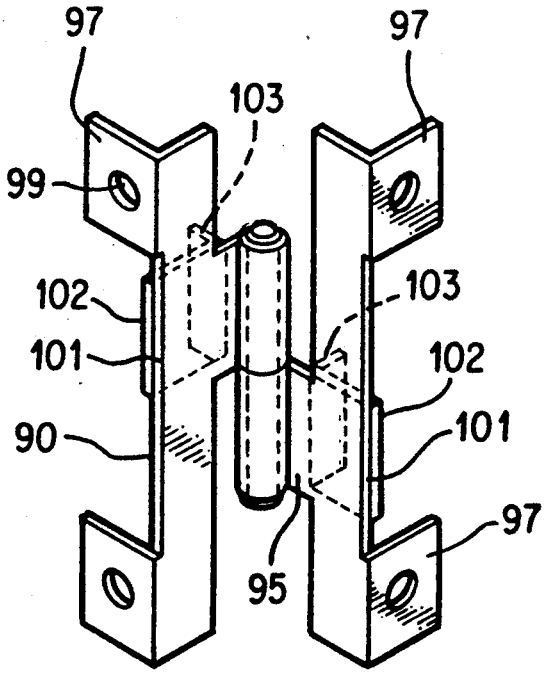

FIG. 3 shows a side view of one of the end parts of one of the elongate members which likewise form integral parts of the wall according to FIG. 1, FIG. 4 shows a top view of the end part according to FIG. 3, FIG. 5 shows a rear view of one of the junction pieces of the wall according to FIG. 1, FIG. 6 likewise shows a perspective view of one of the junction parts of the wall according to FIG. 1, FIG. 7 shows a perspective view of a hinge of the present wall which is also shown in FIG. 6, FIG. 8 shows a top view of the hinge according to FIG. 7, FIG. 9 shows a perspective view of a second embodiment of the said hinge, and FIG. 10 shows a perspective view of a third embodiment of the said hinge.

The wall according to FIG. 1 has rigid elongate members 1. These members 1 form pairs 8, the members 1 of each pair 8 intersecting at a point 18, advantageously in the middle of these. The wall comprises a number of such pairs of members 8. In each pair 8, two end parts of the intersecting members 1 are located in each case on one side of the intersection point 18. It can also be said that the end parts of the elongate members 1 of a pair 8, which are located on one side of the intersection point 18, are in a plane perpendicular relative to that plane in which the members 1 of this pair 8 lie at least approximately. The plane in which the members 1 of a pair 8 lie will be designated below as the main plane of this pair 8. It can be said, furthermore, that the opposite ends of the elongate members 1 of a pair 8 are located in two planes 5 and 6 parallel to and at a distance from one another, and that the intersection point 18 is approximately at the center of the distance between these planes 5 and 6. The members 1 of each pair can be connected to one another in an articulated manner in the region of their intersection point 18. Advantageously, this is carried out by means of a pin (not shown) which passes through those parts of the elongate members 1 which intersect and which rest on one another.

Each pair of members 8 can be arranged within the wall in such a way that its main plane lies either in a horizontal or in a vertical plane, as shown in FIG. 1. Moreover, it is evident from FIG. 1 that the pairs of members 8 can adjoin one another in their longitudinal direction, so that the wall has horizontally and vertically extending rows of intersecting pairs of members 8, and additionally these rows can also mutually intersect.

The end part of each elongate member 1 is connected to a point of a junction piece 2 which is a further integral part of the wall. The wall has a number of such junction pieces 2. The object of these junction pieces 2 is to connect together the end parts of the elongate members 1 of the pairs 8 meeting at a particular part of the wall. As has already been mentioned, the end parts of the elongate members 1 of a pair 8 lie in one of the two planes 5 and 6 situated at a distance from one another. The junction pieces 2 are also located in these planes 5 and 6. Each junction piece 2 is designed so that the end parts of several elongate members 1 can be connected to it. The end parts of two successive pairs of members 8 lying in the same, that is to say horizontal or vertical, plane can be connected to such a junction piece 2. However, the end parts of those members 1 which belong to pairs of members 8 at right angles to one another or belong to intersecting rows of pairs of members 8 can also be connected to a junction piece 2.

The elongate members 1 and the junction pieces 2 together form a carcass or skeleton having a front face and a rear face, the junction pieces 2 being located in these faces. These faces correspond to the planes 5 and 6 already discussed, and they limit the present wall at the front and rear. These faces can also be designated as a front part wall 5 and rear part wall 6. The intersecting members 1 of each pair 8 extend between these part walls 5 and 6.

Since the length of the elongate members 1 in the pairs 8 is identical, the end parts of these members 1 are located at mutually opposite points of the two said part walls 5 and 6. So that the distance between these part walls 5 and 6 can be adjusted or changed, spacer means 9 extend between the part walls 5 and 6. The length of these means 9 is less than the length of the elongate members 1. The spacer means 9 extend virtually perpendicularly relative to the planes of the part walls 5 and 6, and they can contain a piece of thread, wire or the like. The ends of such means 9 can be connected in a known way, for example by means of hooks, to those junction pieces 2 which are located at the mutually corresponding and opposite points of the part walls 5 and 6. However, when there is tensile and compressive loading, these means 9 can also be designed as rigid structures.

Furthermore, each junction piece 2 is designed so that front plates 3 and side plates 4, which are further integral parts of the present wall, can also be fastened to it. The front plates 3 constitute integral parts of the said part walls 5 and 6. On the other hand, the side plates 4 are perpendicular relative to the front plates 3 or to the part walls 5 and 6. At the same time, the side plates 4 can be either horizontal or vertical. If the side plates 4 are arranged horizontally, they can be used as shelves. If they are arranged vertically, they can serve as a lateral termination of the wall.

Each elongate member 1 (FIGS. 2 to 4) has a tubular portion 7, an endpiece 10 being assigned to at least one end of this tube 7. This endpiece 10 is likewise essentially elongate or bar-shaped, and among other things it has a virtually bolt-shaped first part 11. This first part 11 of the endpiece 10 serves for connecting the latter to the tubular portion 7 of the elongate member 1. The diameter of the endpiece bolt 11 or of the connection part 11 of the endpiece 10 is calculated, with regard to the inside diameter of the tube 7, in such a way that the connection part 11 sits firmly in the tube 7, that is to say arranged free of play. The strength of this connection can be increased if special fastening means are used. For example, a layer of a suitable adhesive can be applied between the outer wall of the connection part 11 and the inner wall of the tube 7. The tube 7 should be made of as light a material as possible, such as, for example, aluminum, carbon fibers or the like, so that the carcass of the wall is as light as possible. The endpiece 10 can be made of a suitable plastic. To connect such materials, for example, araldite can be used as an adhesive. A screw or a rivet passing transversely through the tube 7 and the connection part 11 can also be considered as a fastening means.

So that the elongate members 1 have maximum rigidity for a given wall thickness or a given weight of these, the tubes 7 possess grooves extending in their longitudinal direction (not shown). These longitudinal grooves can be made in the outer wall and/or the inner wall of the tube 7.

The second part 12 of the endpiece 10, this part being located outside the tube 7, serves for connecting the elongate member 1 to one of the junction pieces 2 of the present wall. For this purpose, this connecting part 12 of the endpiece 10 has means for making and breaking the connection between the elongate member 1 and one of the junction pieces 2. These means are designed in such a way that no tools are required for actuating them and that it is impossible for these means to cause injury to the hands of the person actuating them.

The connecting part 12 of the endpiece 10 possesses, in the region of transition to the connection part 11, a collar 13 which an approximately prism-shaped portion 20 of the endpiece 10 adjoins. The outer wall of the collar 13 is virtually cylindrical. However, the diameter of the collar 13 is larger than the diameter of the bolt-shaped connection part 11, so that the collar 13 has a virtually annular end face 14 confronting the bolt 11. The end face 15 of the orifice in the associated end of the tube 7 butts against this end face 14 when the endpiece 10 is inserted in the tube 7.

The portion 20 of the connecting part 12 which adjoins the collar 13 has essentially the form of a straight prism, the side edges of this prism 20 extending virtually parallel to the longitudinal axis of the endpiece 10. The cross-section of this prism 20 is essentially quadrilateral. FIG. 3 shows that side wall 27 of this prism 20 which corresponds to the longer side of the said quadrilateral and which therefore has a larger area than that side wall 28 of the prism 20 which corresponds to the shorter side of the quadrilateral. An indentation 21 is made in the prism-shaped endpiece portion 20 perpendicularly relative to the said larger side faces 27 of the latter. A leg 23,24 is located on each side of this indentation 21, these legs constituting the remaining parts of the prism-shaped portion 20 of the endpiece 10. The start of the indentation 21 is adjacent to the curved free end face 22 of the prism-shaped portion 20.

Parallel to the larger side faces 27 of the prism-shaped endpiece portion 20 and approximately in the middle of this is formed a slot-shaped orifice 26 which extends between the smaller sides 28 of the prism 20 and which is intended for receiving a gripping wheel 30. This gripping wheel 30 is located on a shaft 31 which passes transversely through the slot orifice 26 and the ends of which are mounted in the mutually opposite walls 27 limiting the slot orifice 26 laterally. The indentation 21 extending from the curved end face 22 and running in a straight line is made sufficiently long to ensure that its bottom 25 is located in the region of the vertical slot orifice 26. The horizontal indentation 21 open at the front therefore partially overlaps the slot-shaped orifice 26.

The gripping wheel 30 has a curved slot 32 which extends parallel to or almost parallel to the circumferential direction or circumferential contour of the wheel 30. Adjacent to one of the end parts of this curved slot 32, in the gripping wheel 30 is a perforation 33 which extends from the circumferential contour of the gripping wheel 30 as far as the curved slot 32 and which adjoins the latter. The perforation 33 together with the curved slot 32 form an approximately L-shaped track which serves for the selective retention of an axle 45 forming one of the integral parts of the junction piece 2.

A further slot 36, which, although also being curved, is nevertheless closed, is formed in a region of the gripping wheel 30 located approximately diametrically opposite that region of the latter in which the abovementioned curved and open slot 32 is situated. In this second and virtually identically curved slot 36 of the gripping wheel 30 is a pin 37 which is fastened in the inner wall of the slot-shaped orifice 26. The length of the second curved slot 36 determines the length of the pivoting range of the gripping wheel 30 about its shaft 31. The position of the pin 37, the position of the second slot 36 within the gripping wheel 30 and the length of this slot 36 are calculated so that, in one of the stop positions of the limiting pin 37 at one end of the second slot 36, the perforation 33 in the gripping wheel 30 is located opposite the end part of the straight indentation 21 in the prism 20. In the other stop position of the pin 37 in the closed slot 36, the other end of the open slot 32 is located in the region of the inner end part of the straight indentation 21.

For technological reasons above all, the endpiece 10 can be composed of two halves of virtually identical design, the line 34 separating these halves being clearly evident in FIG. 4. In such a case, the gripping wheel 30 has lateral projections which replace the shaft 31 and which are mounted in corresponding depressions in the endpiece halves.

The junction piece 2 possesses a baseplate 40 which is equipped with receiving parts 41 for the endpiece 10 of one of the elongate members 1. These receiving parts 41 are advantageously located on the rear side of the baseplate 40. However, they can also be located on the front side of the latter. FIG. 5 shows how each receiving part 41 is designed and how the receiving parts 41 are arranged on the rear side of the baseplate 40.

The receiving part 41 comprises cheeks 42 and 43 (FIG. 5) which are designed as plates arranged virtually at right angles to the surface of the baseplate 40. The end part 44 of these plates 42 and 43 which is distant from the baseplate 40 is circularly rounded. The mutually opposite faces of the plates 42 and 43 extend virtually parallel to one another, so that there is a gap of constant width between the cheeks 42 and 43 of a receiving part 41. Between the cheeks 42 and 43 extends an axle 45, the ends of which are fastened in the cheeks 42 and 43. The fastening points of this axle 45 are located in a region of the cheeks 42 and 43, in the middle of which is the center of the circular portion 44 on the cheeks 42 and 43.

Figure 2:
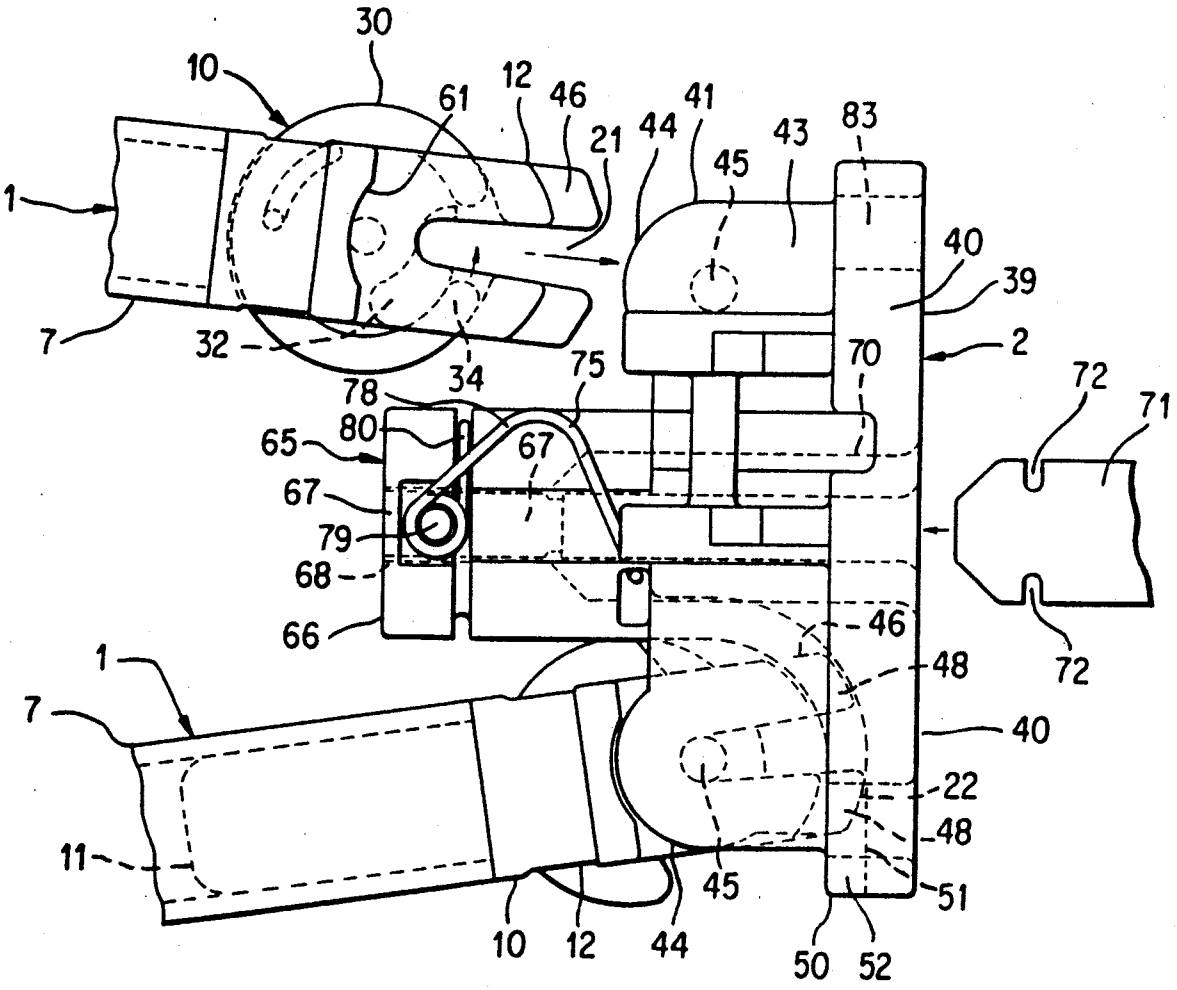
FIG. 2 shows a side view of one of the junction parts of the present wall.

During insertion of the endpiece 10 of an elongate member 1 into one of the receiving parts 41 of the junction piece 2, it is necessary first to ensure that the perforation 33 in the gripping wheel 30 is adjusted so that it is located in the end part of the indentation 21. The prism-shaped portion 20 of the endpiece 10 is then introduced into the receiving part 41. The axle 45 thereby enters the indentation 21 of this endpiece 10, and the endpiece 10 is then pushed into the receiving part 41 until the axle 45 butts against the bottom 25 of the straight indentation 21. This position of the axle 45 is shown at the bottom of FIG. 2. In the last phase of this insertion, the axle 45 enters the perforation 33 in the gripping wheel 30, and at the end of this insertion it is located in the initial part of the open curved slot 32 in the gripping wheel 30. Now, by the action of, for example, the thumb on one of the two segments of the gripping wheel 20 (sic) which project from the prism-shaped piece 20, the gripping wheel 30 can be actuated in such a way that the open slot 32 in the latter moves past the axle 45, the nose 34 of the gripping wheel 30 engaging behind the axle 45.

If the curved open slot 32 is parallel to the edge part of the gripping wheel 30, the said gripping movement of the wheel 30 is terminated either by the butting of the pin 37 against the opposite end of the closed curved slot 36 or by the butting of the axle 45 against the closed end of the open curved slot 32. If the distance between the open slot 32 and the edge of the gripping wheel 30 increases towards the closed end of this slot 32, the closing movement of the gripping wheel 30 is terminated when the friction between the axle 45 and the material of the outer slot wall is so great that no further rotational movement of the gripping wheel 30 is possible.

To break this connection, the gripping wheel 30 is rotated in reverse by hand until the axle 45 still located in the open slot 32 is opposite the perforation 33. The endpiece 10 of the elongate member 1 can then be drawn directly out of the receiving part 41 of the junction piece 2.

As is evident from FIG. 5, the baseplate 40 has a virtually square contour in a plan view. Each side of the baseplate 40 is assigned a receiving part 41, specifically in such a way that the cheeks 42 and 43 of the particular receiving part 41 are virtually at right angles to the respective side and that the axle 45 extending between these cheeks 42 and 43 is virtually parallel to this side of the junction piece. For reasons which will be described later, in the junction piece 2 illustrated in FIG. 5 the particular receiving part 41 is located outside the middle region of the length of the respective side of the junction piece.

To improve the stability of the wall, a multiple guidance of the endpiece 10 in the receiving part 41 is provided.

The first guide means comprises a nose 46 (FIGS. 2 to 4) on the endpiece 10 and a channel 50 (FIG. 5) in the baseplate 40 of the junction piece 2. As is evident from FIG. 4, the nose 46 has plane and mutually parallel side walls 48, and there adjoins these side walls 48 at the front the curved end face 22 already mentioned (FIGS. 2 and 3). The width of the nose 46 is less than the width of the prism-shaped portion 20 on the endpiece 10. Between the side wall 27 of the prism-shaped portion 20 and the side wall 48 of the nose 46 there are therefore transition faces 49, the form of which is virtually identical to the form of the end face 22, as is evident, above all, from FIG. 3. Since the front part of the connecting piece 12 is equipped with the indentation 21 lying in the plane of the shaft 31 of the gripping wheel 30, the nose 46 and the faces 22 and 49 are subdivided by this indentation 21 into two structures of virtually identical form.

Each channel 50 in the junction piece 2 has a virtually rectangular cross-section, so that it has a bottom 51 and side walls 52. As is evident from FIG. 2, however, the channel 50 is curved in its longitudinal direction, specifically in such a way that its bottom 51 extends along the circumference of an arc of a circle, the center angle of which is approximately 90°. Straight terminating portions adjoin the ends of this curved part of the channel bottom 51. When the endpiece 10 is inserted in the junction piece 2 (bottom of FIG. 2), the nose 46 of the connecting piece 12 resets in the channel 50. The width of the nose 46 and the width of the channel 50 are calculated so that the side walls 48 of the nose 46 and the side walls 52 of the channel 50 rest on one another as free of play as possible. The end face 22 on the halves of the nose 46 is shaped so that its form is as close as possible to the form of the channel bottom 51. In particular, the elongate member 1 mounted on the shaft 31 is to be pivotable about this axle 45 as freely as possible.

Second means for increasing the stability of the present wall comprise shoulders 55, each of which is located respectively between the larger side wall 27 of the prism-shaped portion 20 and the collar 13. As mentioned, the outside of the collar is cylindrical. In contrast, the shoulders 55 are angular. The width of the connecting piece 12 in the region of the shoulders 55 is equal to the diameter of the collar 13, as is evident from FIG. 4. The same applies to the height of the shoulders 55 (FIG. 3). FIG. 3 shows the rear edge 56 of the shoulders 55 and FIG. 4 their upper edge 58, the upper edge 58 extending between the side faces 59 of the shoulders 55.

The width of the prism-shaped portion 20 is less than the diameter of the collar 13. Consequently, a connecting face 60 is present between the side face 59 of one of the shoulders 55 and the corresponding side face 27 of the prism-shaped portion 20, this connecting face 60 being perpendicular relative to these side faces 27 and 59. The connecting face 60 has a middle curved portion 61, where the radius of curvature is equal to that of the curved top side 44 of the cheeks 42 and 43. The dimensions of the cheeks 42 and 43 and of the shoulders 55 and the position of these in relation to one another are selected so that the top side 44 of the cheeks 42 and 43 rests on the supporting face 61 of the associated shoulder 55. Since the top side 44 of the cheeks 42 and 43 forms the segment of an arc of a circle, the mutual contact between the shoulders 55 and the cheeks 42 and 43 assigned to them exists in every angular position of the elongate member 1 inserted into the receiving part 41.

Furthermore, the junction piece 2 has a fastening device 65 for elements which allow a connection with other parts in a direction which is perpendicular relative to the part walls 5 and 6. This device 65 comprises a body 66 fastened, at one end, on that side of the baseplate 40 of the junction piece 2 on which the parts 41 for receiving the elongate members 1 are also located. This body 66 is virtually perpendicular relative to the rear side of the baseplate 40, and it has an orifice 67 of essentially round cross-section. This orifice 67 extends in the longitudinal direction of the body 66 and, at the other end, opens out on the front side 39 of the baseplate 40.

The first-mentioned end part of the continuous longitudinal orifice 67 is equipped with an internal thread 68. The threaded bolt of a hook (not shown), to which the thread of the spacer means 9 is connected, can be screwed into this orifice 68. This thread 9 can lead to another hook which is fastened in the same way to one of the junction pieces 2 of the opposite part wall 5 or 6. If the spacer means 9 is to be rigid, it can be designed as a rod, the ends of which are equipped with opposing threads. These threaded parts of the means 9 can be screwed into the body 66 of the mutually opposite junction pieces 2 in one operation.

A widening 70 is formed in that portion 70 of the longitudinal orifice 67 adjacent to the front side 39 of the base plate 40, and this widening 70 serves for receiving one of the end parts of a coupling piece 71. In FIG. 2, only this end part or tip of such a coupling piece 71 is shown. The coupling piece 71 is of flat design and it is advantageously produced from a metal. The front corner parts of this tip are removed, so that the coupling piece 71 can be introduced more easily into the widening 70 of the orifice 67. In the region of the coupling piece 71 adjacent to the front part of the tip there is a depression 72 in each of the opposite narrow sides of the said coupling piece. The cross-section of the widening 70 in the body 66 is quadrilateral, so that the above-described end part of the coupling piece can be accommodated in this.

The other end part of this coupling piece 71 can be designed identically to the end part just described. By means of such a coupling piece 71, one of the junction pieces 2 in a further wall standing nearby can be connected to the first wall. The front sides 39 of the baseplates 40 of the two junction pieces 2 thereby come to rest on one another. However, the other end part of the coupling piece 71 can also be designed as a sleeve with an internal thread (not shown). Articles of various kinds can be fastened to the wall by means of a screw which can be introduced into this sleeve.

A detent device 75 intended for the selective retention of the coupling piece 71 in the orifice 67 of the junction piece 2 is provided. This detent device 75 includes an orifice 76 which passes transversely through the body 66, in a region of the latter located outside the axial region of the body 66. More specifically, this transverse orifice 76 is located in that region of the widening 70 in the longitudinal orifice 67 where there is one of the depressions or one of the indentations 72 of the coupling piece 71 when the latter is introduced in the junction piece 2. A catching portion 77 of the detent spring 78 fastened to this free end part of the body 66 passes through the transverse orifice 76. In the example illustrated, the detent spring 78 is essentially L-shaped, one leg of this spring 78 being shaped so that its end part forms the catching portion 77 for the coupling piece 71. In particular, this catching portion 77 comes to rest in the indentation 72 when the coupling piece 71 is to be retained in the junction piece 2. The middle part of the detent spring 78 surrounds a projection 79 on the outside of the body 66, and the other leg 80 of the spring 78 lies in a continuous groove 81 on the body 66, the spring 78 gaining its support thereby.

It has already been said that the receiving parts 41 for each elongate member 1 are located outside the middle region of the length of the nearest side of the junction piece. The body 66 likewise already described projects from the middle of the baseplate 40 of the junction piece. The said arrangement of the receiving parts 41 gives the individual components of these parts 41 more room, so that the area of the baseplate 40 can be kept as small as possible. Further space for the receiving parts 41 is obtained if the cross-section of the body 66 is essentially quadrilateral (FIG. 5), and if the sides 69 of such a body 66 are virtually perpendicular relative to the respective diagonal of the baseplate 40. The receiving parts 41 are likewise offset laterally relative to the centrally arranged body 66, but the axle 45 of each part 41 extends parallel to the nearest side wall of the junction piece. The channel 50 of each receiving part 41 extends as far as the nearest side 69 of the body 66.

The corner parts of the baseplate 40 of the junction piece 2 have continuous bores 83 (FIG. 5). These bores serve for fastening the front plates 3, side plates 4, hinges 90 and further parts to the junction pieces 2. The front plates 3 can be made of any material and be of any thickness. The corner parts of the front plates 3 have orifices 87. FIG. 5 shows one of the junction pieces 2 in a rear view. The orifice in the upper right-hand corner of this junction piece 2, bearing the reference numeral 83, is assigned the orifice 87 in the lower left-hand corner of the front plate 3. Thus, the corner parts of four front plates 3 can be fastened to a junction piece 2 by assigning one of the corner parts of the front plates 3 lying next to one another to one of the corner parts of the junction piece 2.

The side plates 4 are, as a rule, made of sheet metal and they have edges 84 and 85 bent at right angles to the main face. The lateral edge parts of the plate 4 each have a side strip 85 which is at right angles to the main face of the plate 4. The side strip 85 is removed in a region which is adjacent to the front strip 84 at the front and likewise arranged at right angles to the main face of the side plate 4. The length of this free region 86 is somewhat larger than the thickness of the baseplate 40 of the junction piece 2. An orifice 87 is made in each of the end parts of the bent front strip 84. In the other end of the front strip 84, not shown in FIG. 6, there is a shortening of the latter, the length of this shortening corresponding at least to the length of the web 95 on the hinge 90, in order to provide a passage for the web 95.

In FIG. 6 the upper corner of the side plate 4 is assigned to the lower corner of the junction piece 2. The upper orifice, designated by 87, in the side plate 4 is assigned to the lower orifice, bearing the reference numeral 83, in the junction piece 2, in such a way that these orifices 83 and 87 overlap. At the same time, the front strip 84 comes to rest on the front side of the baseplate 40 and the lateral part of the baseplate 40 is located in the said free space 86 of the side plate 4. For fastening the plates 3 and 4 to the present wall there are bolts 88 which fit into the orifices 83, 87, etc.

The side plate (not shown) located above the side plate 4 just mentioned is assigned in the same way, with its lower corner part having the above-described shortening of the front strip 84, to the orifice 83 in the upper corner of the baseplate 40. An entire side of the wall can thus be equipped with side plates 4. The dimension of the side plates 4 in the direction of the side strip 85 corresponds to the distance between the two part walls 5 and 6.

The present wall also contains hinges 90 which are shown in FIGS. 6 to 10 and which serve for connecting the baseplates 40 of further junction pieces 2 to one of the part walls 5 or 6. The hinges 90 allow the baseplates 40 of the further junction pieces 2 to have the possibility of being at an angle to the baseplates 40 of the junction pieces 2 located in the particular part wall 5 or 6. Further components already described can be connected to the further junction pieces 2, so that the present wall can have several portions which are at an obtuse to even an acute angle relative to one another.

The hinges 90 have hinge plates 91 and 92 which are connected to one another by means of a connecting pin 93. Each hinge plate 91, 92 has a sheet-like basic body 94, and a web 95 in the form of a spur of the material of the basic body adjoins one of the longer sides of this basic body 94. A sleeve 96 is formed at the free end of the web 95. The sleeves 96 of the hinge plates 91 and 92 are aligned with one another and the connecting pin 93 passes through these sleeves. The end parts of the basic body 94 are designed for connecting the hinge plates 91 and 92 to the baseplate 40 of the junction piece 2.

According to FIGS. 7 and 8, each end part of the elongate basic body 94 has tabs 97 and 98 which are approximately at right angles to the main plane of the basic body 84 (sic). Formed in these tabs 97 and 98 is an orifice 99, the diameter of which is selected so that the fastening bolt 88 can pass through this orifice 99. FIG. 6 shows how such a hinge 90 is assigned to the baseplate 40 of one of the junction pieces 2. The basic body 94 of one of the hinge plates of the hinge 90 is assigned respectively to one of the side faces or side edges of the baseplate 40 of one of the junction pieces 2. The corner parts of the baseplate 40, together with the respective passage bore 83, are located between the hinge tabs 97 and 98. The connection is made by means of the bolt 88 which, in FIG. 6, is shown in the position which it assumes before it is introduced into the orifices 83 and 99. Because of the web 95, there is a gap 89 between the basic body 94 and the sleeve 96. The front strip 84 (FIG. 6) of the side plate 4 comes to rest in this gap 89, when the said side plate is fastened to the junction piece 2.

The hinges 90 according to FIGS. 9 and 10 are, in principle, of the same design as the hinge 90 according to FIG. 7. In the hinge according to FIG. 9, an intermediate portion 100 arranged at right angles to the basic body 94 adjoins the end part of the basic body 94. One of the tabs 97 then adjoins the end of this intermediate portion 100. This tab 97 and the part of the basic body 94 located opposite it have the orifices 99 already mentioned.

The hinge according to FIG. 10 differs from the hinge according to FIG. 7 initially in that it has only one tab 97 with the orifice 99. The second tab of the hinge according to FIG. 7 is replaced by an L-shaped member 101, in which the first leg 102 rests flat on the basic body 94. This first leg 102 is advantageously fastened to the basic body 94 in the region of the web 95. The other leg 103 projects at right angles from the basic body 94, specifically from that edge of the latter which is located opposite the edge equipped with the tab 97. In this hinge, the edge part of the baseplate 40 lies between the tab 97 and the member leg 103 serving as a stop.

I claim:

1. A knock-down display wall, said display wall comprising:

a plurality of elongate members, each of said elongate members having a tubular portion and at least one endpiece, a first part of the endpiece being fitted within the tubular portion to form a substantially rigid connection therebetween, and a second part of the endpiece being located outside the tubular portion;

junction pieces for connecting said elongate members to one another to form a framework for said display wall, each junction piece having a base plate with at least one receiving part, said receiving part having plate-shaped cheeks spaced from one another and extending substantially parallel to one another with an axle extending therebetween, said axle being spaced from said base plate, and said base plate having openings for receiving fastening means for fastening auxiliary components to said wall, said auxiliary components being selected from the group consisting of side faces, end faces and hinges;

means for releasably connecting the second part of the endpiece of one of said elongate members and the axle of the receiving part of a corresponding one of said junction pieces, so that said display wall can be easily constructed and knocked-down; and wherein each said junction piece further includes a fastening device, said fastening device facilitating attachment of articles perpendicularly to said side faces, said fastening device including a body substantially perpendicularly coupled to said base plate, said body and said baseplate having a continuous opening extending therethrough with a detent spring disposed therein, and a coupling piece adapted to be inserted into said continuous opening from a front side of said body, said coupling piece interacting with said detent spring when inserted to removably hold said coupling piece within said body.

2. A display wall as in claim 1, wherein endfaces of said cheeks distant from said base plate are curved.

3. A display wall as in claim 1, wherein at least one of said hinges is provided, each said hinge including two hinge plates, each hinge plate having a sheet-like basic body having a web connected thereto, each web having a sleeve formed thereon such that a free space is formed between the basic body and the sleeve, wherein a connecting pin passes through the sleeves of the hinge plates, and wherein the distal ends of said basic bodies are adapted to be connected to said base plate of a corresponding junction piece.

4. A display wall as in claim 3, wherein each distal end has at least one tab extending therefrom, each tab having an opening for receiving said fastening means.

5. A display wall as in claim 1, wherein said continuous openings of the fastening devices of two adjacent junction pieces receives spacer means for spacing a pair of side faces a predetermined distance apart.

6. A display wall as in claim 1, wherein said tubular portion is rigid and has a plurality of grooves extending longitudinally therein.

7. A display wall as in claim 5, wherein at least one of said side faces is provided, said side face having a flange extending substantially orthogonally to the side edges thereof, wherein a portion of said flange is fitted within said free space of said hinge.

8. A knock-down display wall, said display wall comprising:

a plurality of elongate members, each of said elongate members having a tubular portion and at least one endpiece, a first part of the endpiece being fitted within the tubular portion to form a substantially rigid connection therebetween, and a second part of the endpiece being located outside the tubular portion;

junction pieces for connecting said elongate members to one another to form a framework for said display wall, each junction piece having a base plate with at least one receiving part, said receiving part having plate-shaped cheeks spaced from one another and extending substantially parallel to one another with an axle extending therebetween, said axle being spaced from said base plate, and means for releasably connecting the second part of the endpiece of one of said elongate members and the axle of the receiving part of a corresponding one of said junction pieces, so that said display wall can be easily constructed and knocked-down; wherein said means for releasably connecting includes a distal tip of said second part having two longitudinally prongs with a longitudinal slot formed therebetween, said second part also having a curved slot-shaped orifice extending transversely to said longitudinal slot for receiving a gripping wheel rotatably mounted therein, said gripping wheel being dimensioned such that portions of said gripping wheel extend laterally outside said second part, and said gripping wheel having a circumferential slot extending substantially parallel to a circumferential direction of said gripping wheel and a perforation opening onto said slot, wherein said longitudinal slot is sufficiently long that a portion thereof overlaps said slot-shaped orifice, and wherein the width of said circumferential slot and said perforation is such that the axle of said receiving part can be accommodated therein.

9. A display wall as in claim 8, wherein said tubular portion is rigid and has a plurality of grooves extending longitudinally therein.

* * * * *